US005320057A

United States Patent [19]

Dourlain

[11] Patent Number: 5,320,057

[45] Date of Patent: Jun. 14, 1994

[54] BOAT GUIDE

[76] Inventor: William H. Dourlain, 3722 Baker Rd., Orchard Park, N.Y. 14127

[21] Appl. No.: 66,603

[22] Filed: May 30, 1993

[51] Int. Cl.[5] ..... B63B 21/00

[52] U.S. Cl. ..... 114/230; 114/242

[58] Field of Search ..... 114/230, 242

[56] References Cited

U.S. PATENT DOCUMENTS 3,336,896 8/1967 Burnett ..... 114/230

FOREIGN PATENT DOCUMENTS 174387 9/1985 Japan ..... 114/230

1518194 10/1989 U.S.S.R. ..... 114/230

*Primary Examiner*—Jesus D. Sotelo

*Attorney, Agent, or Firm*—Hodgson, Russ, Andrews, Woods & Goodyear

[57] ABSTRACT

Apparatus and a method for guiding objects such as boats in and out of slips. A pair of guide lines on opposite sides of the slip receive guide blocks for movement along the lengths of the guide lines. Each guide block has a pair of block portions movable toward each other to a first position for securing the boat line thereto and movable away from each other to a second position for releasing the boat line. A release line is anchored at one end and attached to each guide block at the other end to have slack during movement of the boat into and out of the slip. When slack in the release lines is taken up during movement of the boat out of the slip, tension applied to the guide block by the release line and the boat line moves the block portions to the second positions for releasing the boat lines.

20 Claims, 3 Drawing Sheets

Fig. 3.
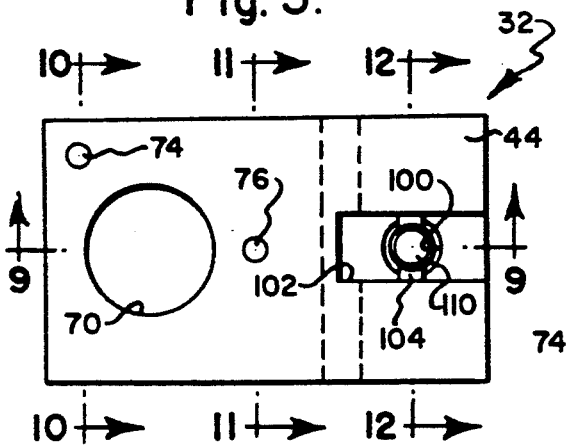
Fig. 4.
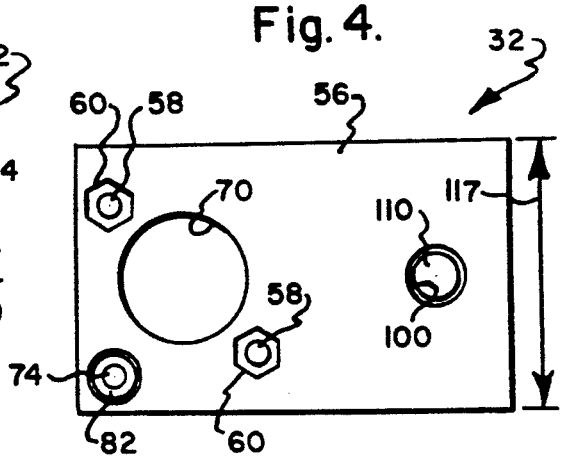
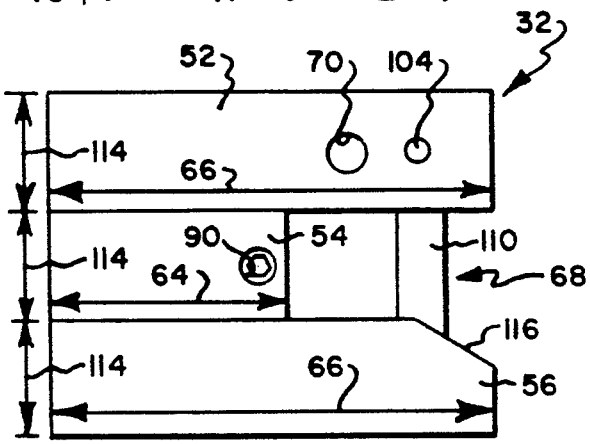
Fig. 5.
Fig. 6.
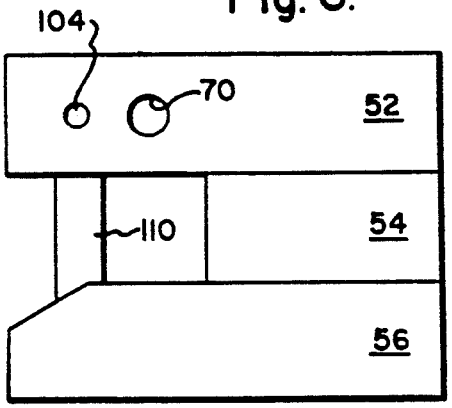
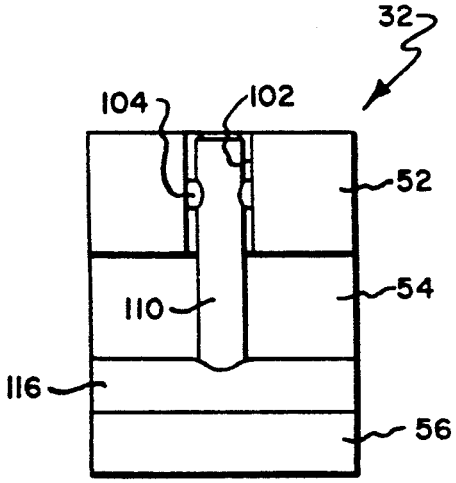
Fig. 7.
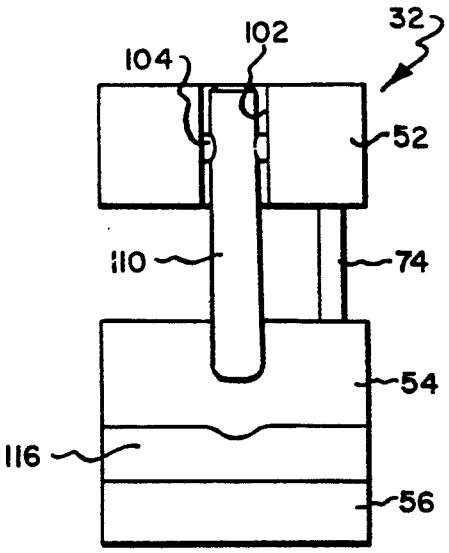
Fig. 8.

BOAT GUIDE

The present invention relates generally to the guiding of boats out of slips.

It is an object of the present invention to nullify the effects of wind and current and keep a boat in the center of a slip while departing the slip.

It is another object of the present invention to cause the boat lines to be automatically released while departing the slip.

It is a further object of the present invention to provide a boat guide apparatus therefor which is inexpensive, rugged, reliable, and easy to use.

In accordance with the present invention, guide lines are mounted on the respective boat sides. At least one guide block for each guide line has an aperture for receiving the guide line for movement of the guide block along the length thereof. The guide block includes a pair of block portions which are movable toward each other to a first position relative to each other for securing a boat line to the guide block. The block portions are movable away from each other to a second position relative to each other for releasing the boat line. A release line is connected at one end to a cleat or other anchoring means and at another end to one of the block portions to have slack during movement of the boat in a direction out of the slip. When the slack in the release line is taken up, tension is effected by the release line and boat line on the guide block for moving the block portions to the second position so that the boat line is automatically released.

The above and other objects, features, and advantages of the present invention will be apparent in the following detailed description of the preferred embodiments thereof when taken in conjunction with the accompanying drawings wherein the same reference numerals denote the same or similar parts throughout the several views.

A BRIEF DESCRIPTION OF THE DRAWINGS

FIG. 3 is a face view of the boat guide of FIG. 2 as it faces the bow of the boat of FIG. 1.

FIG. 4 is a face view thereof as it faces the stern of the boat of FIG. 1.

FIG. 5 is a face view thereof facing upwardly when on the port side of the boat of FIG. 1 and shown in a position (first or closed position) for securing a boat line thereto.

FIG. 6 is a face view thereof facing downwardly when on the port side of the boat of FIG. 1 and shown in the closed position.

FIG. 7 is a face view thereof as shown facing the boat of FIG. 1 and in the closed position.

FIG. 8 is a face view similar to that of FIG. 7 with the boat guide in the open position.

Figure 10:
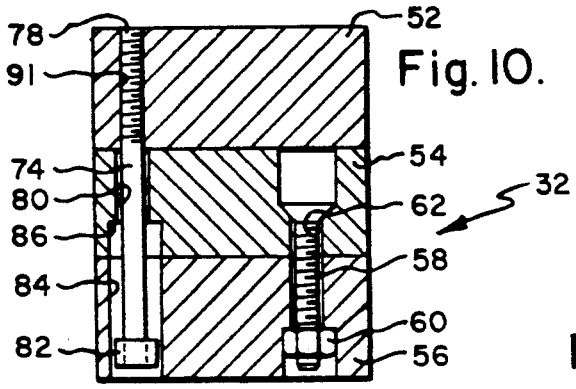
FIG. 10 is a sectional view thereof in the closed position and taken along lines 10—10 of FIG. 3.
Figure 10A:
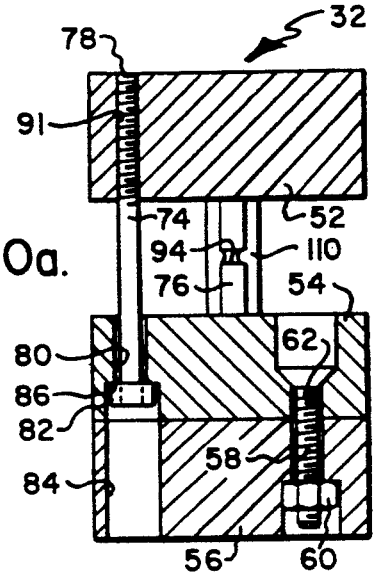

FIG. 10*a* is a sectional view thereof similar to that of FIG. 10 with the boat guide in the open position.

Figure 11:
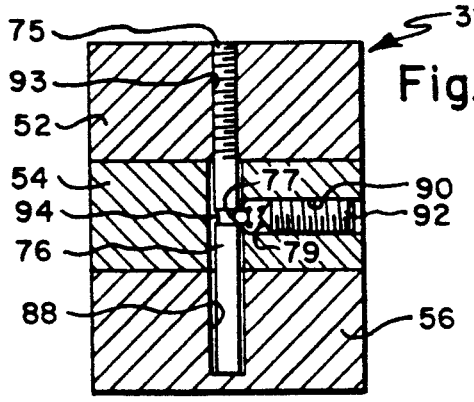

FIG. 11 is a sectional vie thereof in the closed position and taken along lines 11—11 of FIG. 3.

Figure 11A:
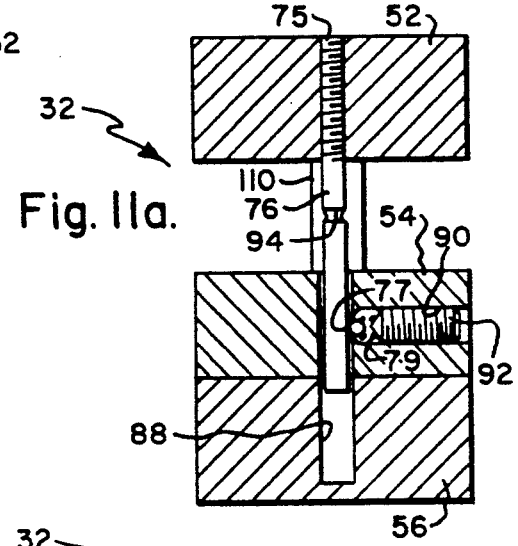

FIG. 11*a* is a sectional view thereof similar to that of FIG. 11 with the boat guide in the open position.

Figure 12:
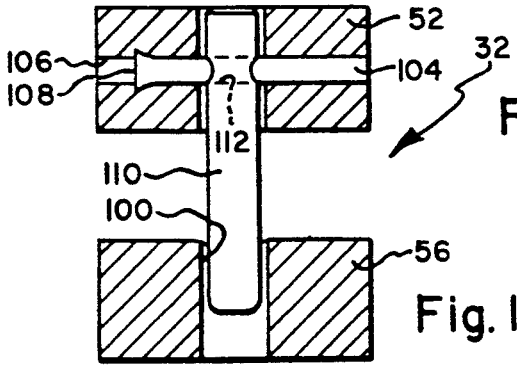

FIG. 12 is a sectional view thereof in the closed position and taken along lines 12—12 of FIG. 3.

Figure 12A:
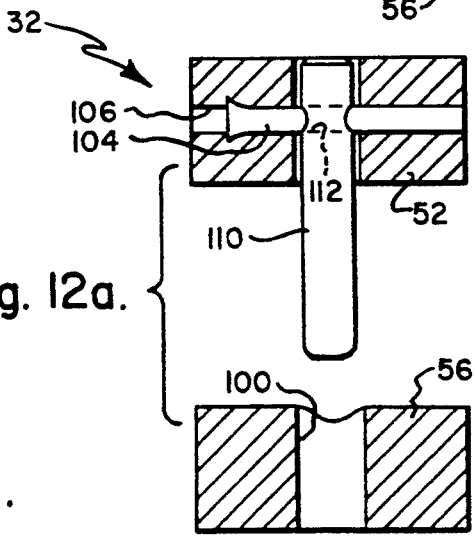

FIG. 12*a* is a sectional view thereof similar to that of FIG. 12 with the boat guide in the open position.

DETAILED DESCRIPTION OF THE PREFERRED EMBODIMENTS

Figure 1:
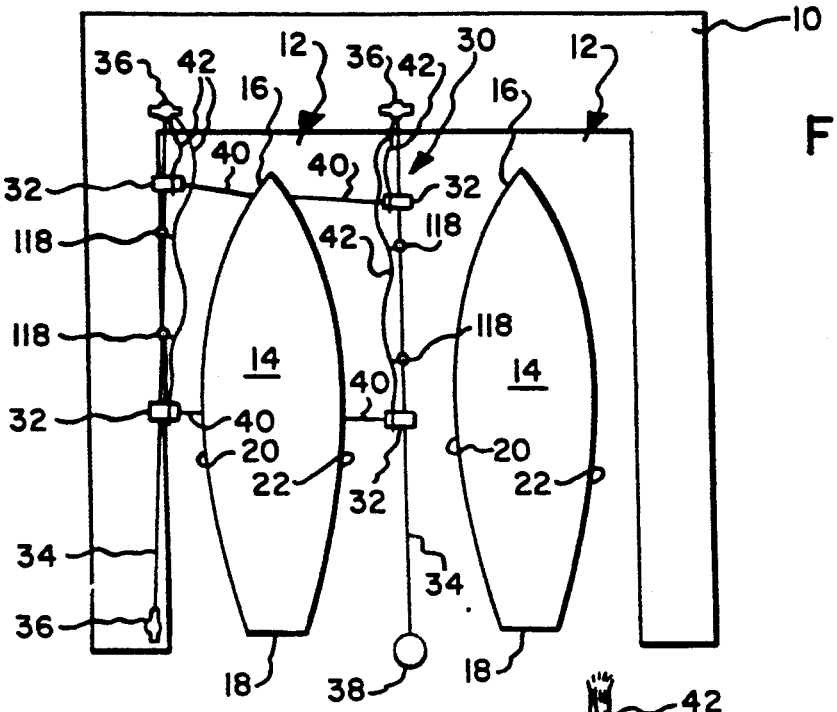
FIG. 1 is a schematic view illustrating apparatus which embodies the present invention connected to a boat for guiding thereof out of a slip.

Referring to FIG. 1, there is illustrated at 10 a boat dock which has a couple of slips, illustrated at 12, for boats 14 which may typically be sail boats or power boats used for pleasure. The present invention is not limited to use with such boats. For example, the present invention may be used with small fishing boats or even objects to be maneuvered which are not boats. Each of the boats 14 has a front or bow 16, a rear or stern 18, a left or port side 20, and a right or starboard side 22.

The boats 14 must be guided into and out of their respective slips 12 in such a way as to prevent contact with and possible damage to other boats and to prevent damaging contact with the dock. This task is made difficult sometimes by the effects of wind and current, especially as a boat is leaving the slip. It is desirable to keep the boat generally in the center of the slip as it departs the slip. It is also desirable that any boat guide apparatus which is used be automatically released while the boat is departing the slip instead of requiring manual release thereof at a time when the crew is occupied with many other things. In order to provide inexpensive, rugged, reliable, and easy to use apparatus for guiding a boat out of a slip and for automatically releasing the boat lines as the boat departs, in accordance with the present invention there is illustrated generally at 30 boat guide apparatus which comprises at least one guide block 32 along each side of the slip 12, one guide block for each boat line 40. A 36-foot sailboat may require only one guide block 32 along each side of the slip. As shown, two or more guide blocks 32 along each side of the slip may be required for larger boats. Guide blocks 32 are mounted for movement along the length of respective guide lines 34 which extend generally parallel to the lengthwise or fore and aft direction of the boat 14 along each side thereof and generally define the slip 12. All of the guide blocks on one side of the boat may be, but are not required to be, mounted to a single guide line, as shown in FIG. 1. The dock side guide line 34 is suitably attached tautly between a pair of cleats 36, and the other guide line is attached tautly between a cleat 36 on the dock and a post 38 in the water. Thus, the guide lines 34 are generally parallel to each other and taut, and the boat 14, when docked, is oriented between the guide lines 34. Boat lines 40 are detachably attached to the guide blocks 32 respectively as will be discussed in greater detail hereafter. As the boat 14 is backed out of the slip 12, the boat lines 40 pull the respective guide blocks 32 along the length of the guide lines 34.

Release lines 42 are also connected to the guide blocks 32 and to the respective forward cleats 36 or other suitable anchor means in such a way as to have slack when the boat is docked as illustrated in FIG. 1. The purpose of these release lines 42 will be described in greater detail hereinafter. What may be noted at this point is that as the boat 14 is backed out of the slip 12, the slack is taken up so that the release lines 42 will become taut. Thus, when the slack in the release lines 42 is taken up and the boat 14 continues backing up, there will be a pulling or tension effect on the guide blocks 32.

Figure 2:
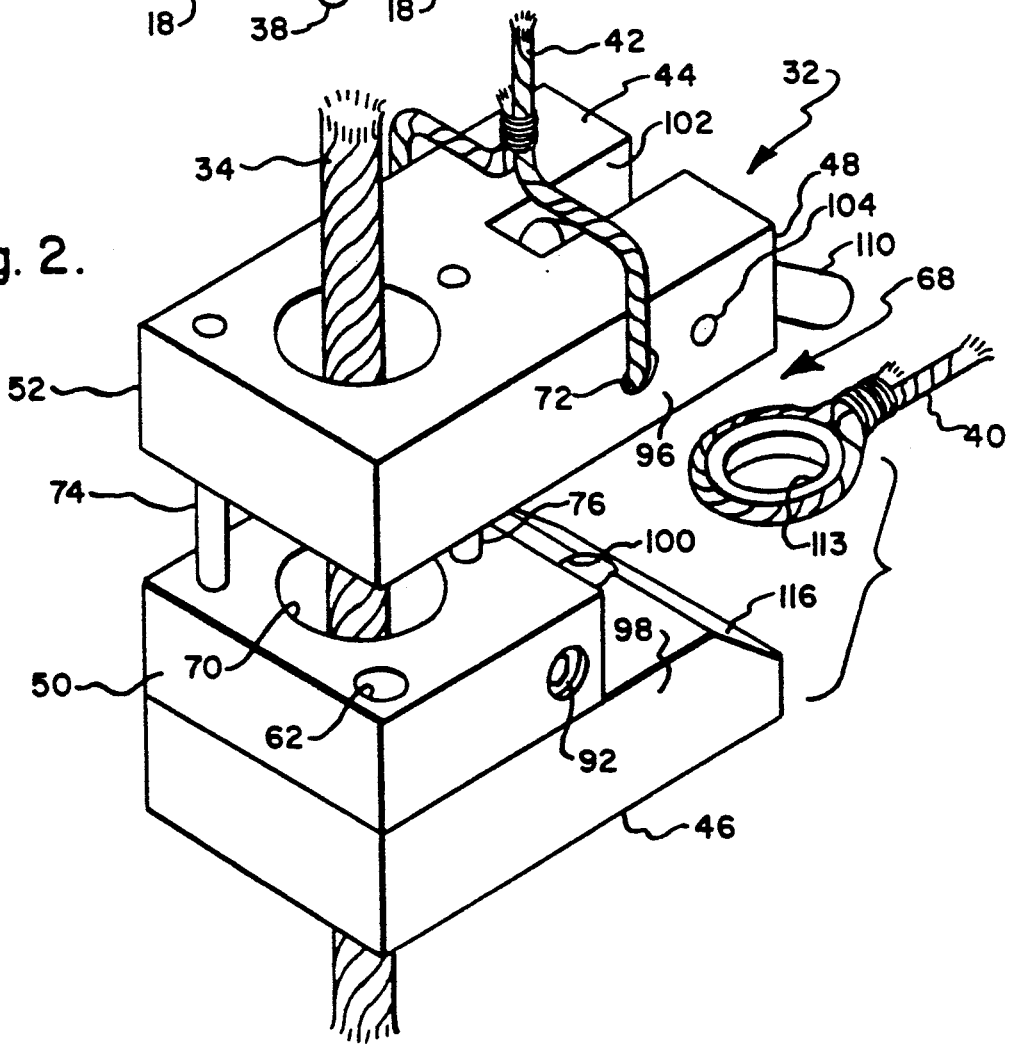
FIG. 2 is a perspective view of a guide block for the apparatus of FIG. 1 shown in a position (second or open position) releasing a boat line.

Referring to FIGS. 2 to 12, there is shown one of the guide blocks in greater detail. FIGS. 5, 6, 7, 9, 10, 11, and 12 show the guide block 32 in a first or what might be called closed position. FIGS. 2, 8, 10*a*, 11*a*, and 12*a* show the guide block 32 in a second or what might be called open position. As best seen in FIGS. 2, 7, and 8, the guide block 32 comprises two portions 44 and 46 which engage each other when in the closed position and which are spaced apart when in the open position. For ease of discussion, these portions will be called a fore portion 44 and an aft portion 46. When properly mounted on the guide line 34, the fore portion 44 faces forwardly and the aft portion 46 faces rearwardly or away from the dock 10, as seen in FIG. 1. Further, the guide block 32 has an inboard side, illustrated at 48, which faces the boat 14, and an outboard side, illustrated at 50.

The guide block 32 is shown to be composed of three pieces or blocks of suitable material. A first piece 52 forms the fore portion 44. The second and third pieces 54 and 56 respectively are rigidly attached together such as by screws 58 and nuts 60 within apertures 62 which pass entirely through the second and third pieces 54 and 56 respectively and have counterbores at each end for receiving the screw heads and nuts 60, as shown in FIGS. 10 and 10*a*, or by other suitable means. The first and third pieces 52 and 56 respectively are generally about the same size, and the second piece 54 is sandwiched therebetween. The outboard sides of all three of the pieces 52, 54 and 56 generally lie in a common plane, and the second piece, 54, has a length (distance in a direction between the inboard and outboard sides 48 and 50 respectively), illustrated at 64 in FIG. 5, which is less than the length, illustrated at 66 in FIG. 5, of each of the first and third pieces 52 and 56 respectively to define a space or channel, illustrated at 68, in the inboard side 48 between the first and third pieces 52 and 56 respectively, the inboard side of the second piece 54 defining the bottom of the channel 68. The width of the channel is thus equal to the thickness of the second piece 54 when in the closed position and increases to a greater width when in the open position. If desired, the aft portion 46 may be formed as a single piece. Alternatively, the guide blocks 32 may be formed so that the first and second pieces 52 and 54 respectively, either as separate pieces connected together or as a single piece, comprise a fore portion thereof. The pieces 52, 54, and 56 are preferably composed of a ultraviolet light-resistant and salt-resistant material such as black Delrin plastic or may be composed of any other suitable material.

Figure 9:
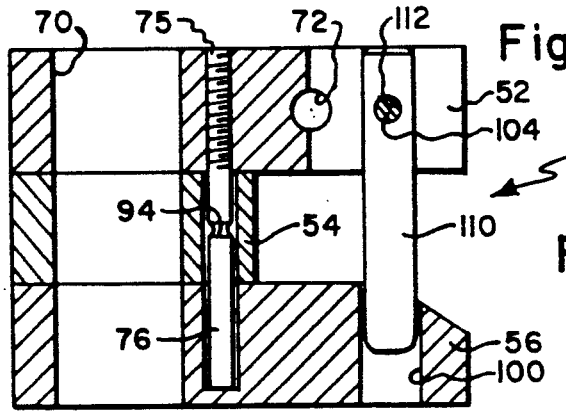
FIG. 9 is a sectional view thereof in the closed position and taken along lines 9—9 of FIG. 3.

An aperture 70 is formed through the entire thicknesses of all three of the pieces 52, 54, and 56 to receive the guide line 34 so that the guide block 32 may slide along the length of the guide line 34. The aperture 70 comprises apertures in each of the pieces 52, 54, and 56 which are aligned with each other, as shown in FIG. 9.

The release line 42 is attached to the first piece 52 by means of an aperture 72 which extends through the width of the first piece 52 for receiving the release line 42 which is passed therethrough and suitably secured.

The fore and aft portions 44 and 46 respectively are secured to each other for movement between the open and closed positions by a pair of pins or rods 74 and 76, and end portions of both of which are threadedly received in threaded apertures 91 and 93 respectively in the fore portion 44 by means of screw threads 78 and 75 respectively. Apertures 91 and 93 may be threaded over the entire fore portion thickness, as illustrated in FIGS. 10 and 11, or over suitable portions such as one-half of the lengths thereof through the fore portion thickness. As seen in FIG. 10, the other end portion of pin 74 is tightly or snugly received in an aperture 80 which extends through the thicknesses of both the second and third pieces 54 and 56 respectively and terminates at an end to which is tightly secured a nut 82. A counterbore 84 extends through the thickness of the third piece 56 and into the second piece 54, the nut 82 being movable through the length of the counterbore 84 to permit the fore and aft portions 44 and 46 respectively to move between the open and closed positions. The nut 82 engages the shoulder 86 of the counterbore 84 to limit the distance which the fore and aft portions 44 and 46 respectively are spaced apart, as shown in FIG. 10A.

As seen in FIG. 11, the other end portion of pin 76 is tightly or snugly received in an aperture 88 in the second and third pieces 54 and 56 respectively for movement therein as the fore and aft portions 44 and 46 respectively are moved between the open and closed positions. A threaded aperture 90 extends from the upper surface of the second piece 54 through the second piece to and in communication with aperture 88 for threatedly receiving a set screw 92, as seen in FIG. 11. Thus, aperture 90 and accordingly set screw 92 is oriented radially to aperture 88. The pin 76 has a circumferential notch or groove 94 which is positioned axially thereon to be aligned, when in the closed position, with the set screw 92, as seen in FIG. 11. A ball bearing 77 is contained within the aperture 90 and spring-biased by means of a suitable spring 79 and set screw or bearing pin 92 acting thereon to engage notch 94 and thereby exert a resistance to movement of rod 76 within aperture 88 thus requiring a force for movement from the closed toward the open position. The amount of such force required is adjustable by tightening or loosening the bearing pin 92 so that the guide block 32 may be prevented from inadvertent opening.

The pin 74 is provided, in addition to pin 76 and bearing pin 92, to reduce any "slop" between the fore and aft portions 44 and 46 respectively for a more stable connection therebetween as well as to prevent the fore and aft portions from completely separating.

The portions 96 and 98 of the first and third pieces 52 and 56 respectively which extend beyond the second piece 54 will be defined herein as the inboard portions respectively thereof. An aperture 100 is provided through the thickness of the inboard portion 98 generally centrally of the width thereof. The axis of aperture 100 is spaced from the second piece 54. A slot 102 is provided to extend into the first piece 52 from the inboard side thereof and generally centrally of the width thereof. As seen in FIG. 12, a pin 104 is tightly secured in an aperture 106 in the first piece 52 to extend across slot 102, the pin 104 having an enlarged head 108 permitting it to be forced into the aperture 106 for a tight fit.

A retaining pin 110 is swingably mounted at one end portion thereof within the slot 102 to the pin 104 by means of an aperture 112 in the retaining pin which receives pin 104 for swinging movement of the retaining pin about pin 104. The retaining pin 110 is mounted so as to be aligned with aperture 100 so that it is receivable in aperture 100, as seen in FIG. 9, when in the closed position. Retaining pin 110 is sized so that it is movable out of the aperture 100 for swinging outwardly (toward the boat), as shown in FIG. 2, when in the open position. The retaining pin 110 is also positioned so that, when in the closed position as seen in FIG. 5, it is spaced from the second piece 54. The aperture 72 is positioned so as to be in alignment and communication with the bottom of the slot 102 so that the release line 42 may be more easily inserted through the aperture 72.

The length of counterbore 84 is preferably minimized so that retaining pin 110 just clears the aperture 100 and swings outwardly to release the boat line. This allows the length of the remaining portion of aperture 80, which snugly receives pin 74, to be maximized for more effectively preventing binding.

In order to securely attach the boat line 40 to the guide block 32, the retaining pin 110 is passed through the eye 113 of the boat line 40 and then into aperture 100 while moving the fore and aft portions 44 and 46 respectively together, to the closed position, and the closed position is maintained by the resistance afforded by the spring-biased ball 77, which is adjustable by the bearing pin 92 to the resistance desired. When the boat 14 has moved out of the slip a distance equal to perhaps half of its length, the slack in the release lines 42 will be taken up, and the release lines 42 will exert a pulling force on the fore portion 44, and the pulling force of the boat line 40 on the aft portion 46 thereagainst will overcome the resistance to movement provided by the spring-biased ball 77 to effect movement to the open position shown in FIG. 2 wherein the retaining pin 110 is released from the aperture 100, swings outwardly, and releases the boat line 40 automatically, and the boat 14 is free to go when all of the boat lines have been thusly released. The length of each of the release lines is thus selected to provide the desired amount of slack. To each of the release lines may be attached at least one such as perhaps 2 or 3 or more clips, illustrated at 118, spaced over the length thereof and having eyes which receive the respective guide line 34 for movement along the length thereof, similarly as the guide blocks 32 are moved along the length thereof, so as to keep the release lines from getting into the water or from getting tangled. The guide blocks 32 may be left in the position that they are in when the boat lines are released and with the release lines remaining attached. The boat 14 may thereafter, as desired, be easily secured to the guide blocks 32 for guiding the boat into the slip by receiving the retaining pin 110 in the boat line eye and moving the fore and aft portions 44 and 46 respectively together while aligning the retaining pin 110 to be received within the aperture 100. The boat 14 may then be guided the rest of the way into the slip 12 by means of the guide blocks 32, the guide blocks 32 remaining permanently secured to the guide lines 34 and release lines 42. The boat lines on the port side would then be taken in and those on the starboard side let out for the purposes of docking the boat on, for example, the port side.

For purposes of illustration only and not for purposes of limitation, the following is an example of a suitable guide block. Each of the pieces 52, 54 and 56 may have a thickness, illustrated at 114, of perhaps about ¾ inch and a width, illustrated at 117, of perhaps about 1¾ inch. The first and third pieces 52 and 56 respectively may each have a length 66 of perhaps about 3 inches, and the second piece 54 may have a length 64 of perhaps about 1 11/16 inch. The diameter of aperture 70 may perhaps be about ⅞ inch, and its center may be spaced perhaps about ¾ inch from the outboard side 50. Aperture 88 may perhaps be, within the first piece 52, a ⅛ inch hole with a 3/16 inch-24 tap, and, within the second and third pieces 54 and 56 respectively, a 13/64 inch hole having a length of perhaps about 1¼ inch. The center of aperture 88 may be spaced perhaps about 1 7/16 inch from the outboard side 50. Pin or rod 76 may have a length of perhaps about 2 inches, a diameter of perhaps about 3/16 inch, and have a 3/16 inch-24 thread 79 over a length of ¾ inch from one end, and circumferential groove or notch 94 is spaced perhaps about 1⅛ inch from that end. Aperture 80 may be located perhaps about ¼ inch from both respective adjacent edges of the guide block. Its top ¾ inch (which is in first piece 52) has perhaps about a 3/16 inch-24 tap. The portion thereof which extends into the second piece may have a diameter of perhaps about 13/64 inch over a distance of perhaps about 15/16 inch. The counterbore 84 may have a diameter of perhaps about 21/64 inch over a distance of perhaps about 9/16 inch through the third piece 56 and into the second piece 54. Pin or rod 74 may have a diameter of perhaps about 3/16 inch, a length of perhaps about 2¼ inches, a 3/16 inch-24 thread 78 over perhaps about ¾ inch at one end for connection to the first piece 52, and a 3/16 inch-24 thread over perhaps about ¼ inch at the other end for receiving nut 82, which may perhaps be a round 5/16 inch nut. This allows the fore and aft portions 44 and 46 respectively to open so that they are spaced apart a distance equal to perhaps about 7/16 inch. Nuts 60 may also be round. Aperture 106 has a diameter of perhaps about 3/16 inch, and its center is spaced perhaps about ½ inch from the inboard side 48. The diameter of aperture 100 may perhaps be about ⅜ inch, and the diameter of retaining pin 110 may perhaps be about 5/16 inch. Retaining pin 110 may have a length of perhaps about 2 inches. The diameter of aperture 112 may perhaps be about 13/64 inch, and its center spaced perhaps about ¼ inch from the end of retaining pin 110. Pin 104 may have a diameter of perhaps about 3/16 inch and a length of perhaps about 1¾ inch. The third piece 56 is chamfered, as illustrated at 116, over a distance lengthwise of perhaps about ½ inch to a thickness at the inboard side 48 of perhaps about ½ inch. Release line aperture 72 may have a diameter of perhaps about ¼ inch for receiving a 3/16 inch release line, and its center may be located a distance of perhaps about 1 inch from the inboard side 48. Tolerances in the above example are plus and minus 1/64 inch. All corners are rounded. The pins and ball 77 are preferably stainless steel, and the block pieces are preferably black delrin plastic.

As the boat 14 departs the slip 12, the slack from the release lines 42 is reduced. When all of the slack is taken up, the pulling force from the boat overcomes the retaining force or resistance provided by the spring-biased ball 77 engaging notch 94. As a result, the fore and aft portions 44 and 46 respectively separate and the retaining pin 110 is released from aperture 100 and swings about pin 104 to open and release the boat line 40, which may perhaps be a ½ inch line. The guide block 32 is retrieved via the release line 42.

Thus, by adjusting bearing pin 92 to adjust the amount of force provided by the ball 77 against the notch 94, the amount of force required to open the guide block may be adjusted so that it is not opened inadvertently yet acts to guide a boat leaving a slip and conveniently allows opening thereof to automatically release the respective boat line as the slip is cleared.

It should be understood that while the invention has been described in detail herein, the invention can be embodied otherwise without departing from the principles thereof, and such other embodiments are meant to come within the scope of the present invention as defined by the appended claims.

What is claimed is:

1. A block for guiding movement of an object comprising a pair of block portions, means for effecting movement of the block along a guide line, means for effecting movement of said block portions toward and away from each other between first and second positions respectively, and means for retaining a line from the object when said block portions are in said first position and for releasing the object line when said block portions are in said second position.

2. A block according to claim 1 further comprising a third block portion between said pair of block portions, said pair of block portions having segments which extend beyond a side of said third block portion to define a space between said segments, aperture means in one of said segments, pin means having a first end portion swingably attached to an other of said segments and a second end portion receivable in said aperture means when said pair of block portions are in said first position for retaining the object line and removed from said aperture means when said block portions are in said second position for releasing the object line.

3. A block according to claim 2 further comprising means defining a notch in said other segment, pin means extending across said notch means, means defining an aperture extending radially through said retaining pin means first end portion in which said pin means which extends across said notch means is received.

4. A block according to claim 2 wherein the object is a boat and the object line is a boat line, said means for effecting movement of said block portions comprising aperture means in one of said pair of block portions for receiving a release line to effect movement of said block portions to said second position under tension by the release line on said one block portion and the boat line on an other of said pair of block portions.

5. A block according to claim 4 wherein said means for effecting movement of said block portions comprises a first rod having one end portion which is fixedly attached to a first of said pair of block portions and an other end portion which is slidable within an aperture in a second of said block portions and including stop means for preventing movement of said other end portion of said first rod out of the aperture in said second block portion.

6. A block according to claim 5 wherein said means for effecting movement of said block portions further comprises a second rod having one end portion which is fixedly attached to one of said pair of block portions and an other end portion which is slidable within an aperture in an other of said block portions, and means for applying resistance to movement of said block portions from said first to said second position.

7. A block according to claim 6 wherein said resistance applying means comprises means defining a notch circumferentially about said second rod, bearing means for engaging said notch means when the block is in said first position, and means for adjustably spring-biasing said bearing means to adjust resistance to movement of said block portions from said first position.

8. A block according to claim 1 wherein said means for effecting movement of the block along a guide line comprises aperture means for receiving the guide line.

9. A block according to claim 1 wherein the object is a boat and the object line is a boat line, said means for effecting movement of said block portions comprising means for attaching a release line to one of said pair of block portions and for attaching the boat line to effect movement of said block portions to said second position under tension by the release line on said one block portion and the boat line on an other of said block portions.

10. A block according to claim 1 further comprising means for limiting the distance which said block portions are spaced apart when moved relative to each other from said first position.

11. A block according to claim 1 further comprising means for adjustably applying resistance to movement of said block portions relative to each other from said first position.

12. A block according to claim 1 composed of a material which is resistant to ultra-violet light and salt.

13. A block according to claim 1 composed of black Delrin.

14. Apparatus for guiding a boat from a slip comprising a pair of guide lines mountable along opposite sides of the slip for guiding the boat into and out of the slip, at least one guide block for each of said guide lines, said guide block having means for receiving said respective guide line for movement of said guide block along the length of said respective guide line, said guide block including a pair of block portions movable toward each other to a first position relative to each other for securing a boat line to said guide block and movable away from each other to a second position relative to each other for releasing the boat line, the apparatus further comprising a release line for each guide block, the release line being anchorable at one end thereof and connectable at an other end thereof to one of said block portions of said respective guide block and having a length to have slack during movement of the boat into and out of the slip between said guide lines whereby when slack in said release lines is taken up during movement of the boat out of the slip to effect tension by the release line and boat line on said respective guide blocks for moving the block portions to said second positions for release of the boat lines respectively.

15. Apparatus according to claim 14 further comprising a third block portion between said pair of block portions, said pair of block portions having segments which extend beyond a side of said third block portion to define a space between said segments, aperture means in one of said segments, pin means having a first end portion swingably attached to an other of said segments and a second end portion receivable in said aperture means when said pair of block portions are in said first position for retaining the boat line and removed from said aperture means when said block portions are in said second position for releasing the boat line.

16. Apparatus according to claim 14 wherein said means for receiving said respective guide line comprises aperture means extending through said block.

17. A block according to claim 14 further comprising means for limiting the distance which said block portions are spaced apart when moved relative to each other from said first position.

18. A block according to claim 14 further comprising means for adjustably applying resistance to movement of said block portions relative to each other from said first position.

19. A method for guiding a boat out of a slip comprising the steps of:

a. providing at least one guide block on each of a pair of guide lines, between which the boat is to be guided, for movement of the guide blocks along the lengths of the guide lines respectively, each guide block having a pair of block portions movable toward each other to a first position for securing a boat line to the guide block and movable away from each other to a second position for releasing the boat line, each of the guide blocks having a release line secured to one of the block portions at one end and anchored at an other end thereof;

b. securing boat lines to the blocks to apply tension to an other of the block portions when slack in the respective release lines is taken up during movement of the boat while moving the block portions to the first positions;

c. allowing slack in the release lines; and d. moving the boat out of the slip guided between the pair of guide lines whereby when slack in the release lines is taken up to effect tension by the release line on the one block portion and by the boat line on the other block portion of the guide blocks respectively for moving the block portions to said second positions for release of the boat lines respectively.

20. A method according to claim 19 further comprising adjusting the amount of tension required for movement of the block portions from the first position.

* * * * *